US011604424B1

(12) United States Patent
Gutberlet et al.

(10) Patent No.: US 11,604,424 B1
(45) Date of Patent: Mar. 14, 2023

(54) DEVELOPMENT SYSTEM WITH DEVELOPER BELT

(71) Applicant: Xerox Corporation, Norwalk, CT (US)

(72) Inventors: Douglas A Gutberlet, Ontario, NY (US); Eliud Robles Flores, Webster, NY (US); Paul F Sawicki, Rochester, NY (US); Varun Sambhy, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 17/668,118

(22) Filed: Feb. 9, 2022

(51) Int. Cl.
*G03G 15/09* (2006.01)

(52) U.S. Cl.
CPC ..... *G03G 15/0921* (2013.01)

(58) Field of Classification Search
CPC ..... G03G 15/0921
See application file for complete search history.

(56) References Cited

U.S. PATENT DOCUMENTS

| | | | |
|---|---|---|---|
| 8,005,410 | B2 | 8/2011 | Wu |
| 2004/0114969 | A1 | 6/2004 | Manno |
| 2020/0356029 | A1 | 11/2020 | Takei et al. |

FOREIGN PATENT DOCUMENTS

| | | | |
|---|---|---|---|
| JP | 5134869 | B2 * | 1/2013 |

OTHER PUBLICATIONS

English machine translation of Fujishima et al. (JP 5134869 B2) (Year: 2013).*

* cited by examiner

*Primary Examiner* — Walter L Lindsay, Jr.
*Assistant Examiner* — Geoffrey T Evans
(74) *Attorney, Agent, or Firm* — Lippes Mathias LLP

(57) ABSTRACT

A development system includes a housing configured for accommodating a developer material which includes toner particles. At least one magnetic roller is positioned within the housing to attract the developer material to a surface of the magnetic roller(s). A continuous developer belt is positioned to attract the toner particles from the at least one magnetic roller to a surface of the developer belt. The developer belt is carried on a plurality of developer rollers. One of the developer rollers is positioned adjacent to an image transfer member, such as a belt or drum, with a photoconductive surface. Some of the toner particles are transferred to a latent image formed on the image transfer member to generate a toner image layer, which is applied to a sheet of print medium.

13 Claims, 9 Drawing Sheets

DEVELOPMENT SYSTEM WITH DEVELOPER BELT

INCORPORATION BY REFERENCE

The following references, the disclosures of which are incorporated herein in their entireties by reference, are mentioned:

US Pat. No. 8,005,410 B2, issued Aug. 2, 2011, entitled POLYIMIDE INTERMEDIATE TRANSFER COMPONENTS, by Wu, describes an intermediate transfer belt that includes a thermosetting polyimide.

US Pub. No. 20200356029A1, published Nov. 12, 2020, entitled BELT, INTERMEDIATE TRANSFER BELT, AND IMAGE FORMING APPARATUS, by Takei, et al., describes a belt which includes a polyimide-based resin with carbon black particles in an outer layer.

US Pub. No. 20040114969A1, published Jun. 17, 2004, entitled DEVELOPMENT SYSTEM, by Manno, describes a development system including a magnetic developer roll including a rotatable sleeve having located therein a rotatable magnetic core, and a developer material delivery system for providing a metered supply of developer material to the rotatable sleeve.

BACKGROUND

The exemplary embodiment relates to electrophotographic printing and finds particular application in connection with a development system with developer belts of variable length.

The process of electrophotographic printing generally includes charging a surface of a photoconductive member, such as a belt or drum, to a substantially uniform potential to sensitize the surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles triboelectrically charged and adhering thereto. A single-component developer material typically comprises toner particles. Toner particles are attracted to the latent image, forming a toner powder image on the photoconductive surface. The toner powder image is subsequently transferred to a sheet of print media, either directly, or via an intermediate transfer member. Finally, the toner powder image is heated to fuse it more permanently to the print media sheet in image configuration.

In many development systems, a magnetic roller ("mag roll") is used to transfer toner particles from a developer housing to the photoconductive surface. To allow a number of development systems to be positioned around the photoconductive member or intermediate transfer member, each development system is configured slightly differently so that the mag roll can contact the photoconductive member. The development systems are thus not interchangeable. Additionally, replacing the toner containers is not always easy since they are not in alignment with each other. These factors tend to increase downtime of the printing device and add cost to the printing device.

There remains a need for an interchangeable development system which is capable of use in more than one position relative to a photoconductive surface.

BRIEF DESCRIPTION

In accordance with one aspect of the exemplary embodiment, a development system includes a housing configured for accommodating a developer material which includes toner particles. At least one magnetic roller within the housing attracts the developer material to a surface thereof. A continuous developer belt attracts the toner particles from the at least one magnetic roller to a surface of the developer belt. A plurality of developer rollers carry the developer belt around them. One of the rollers is positioned adjacent to an associated image transfer member, whereby some of the toner particles are transferred to a latent image formed on the image transfer member.

In accordance with another aspect of the exemplary embodiment, a marking device includes a plurality of the development systems as described above.

In accordance with another aspect of the exemplary embodiment, a printer includes the marking device as described above and a sheet transport system which conveys associated sheets of print media through the marking device to receive toner image layers from the image transfer member.

In accordance with another aspect of the exemplary embodiment, a method of printing includes providing a first developer material in a first housing, the first developer material including first toner particles, transferring some of the first toner particles to a first continuous developer belt, developing a first latent image on a first image transfer member with some of the transferred toner particles to form a first toner image layer, and transferring the first toner image layer to a sheet of print media.

In accordance with another aspect of the exemplary embodiment, a printer includes a print media source, a marking device, which receives print media from the print media source and applies toner images to the print media, The marking device includes an image transport member, at least one charging station, which charges a photoconductive surface of the image transport member, an exposure station, which forms a latent image on the charged photoconductive surface, at least one development system, and a sheet transport system which conveys a sheet of the print media from the print media source to the marking device to receive a toner image layer from the image transfer member. Each development system includes a housing configured for accommodating a developer material which includes toner particles, a continuous developer belt which carries the toner particles from the housing to the surface of the image transfer member to develop the latent image on the image transfer member to form the toner image.

DETAILED DESCRIPTION

Aspects of the exemplary embodiment relate to a development system incorporating a developer belt, to a marking device incorporating the development system, and to a method of printing which can be performed with the system.

As explained in further detail below, the exemplary system helps to optimize space usage, part commonality, and development latitude in an electrophotographic printer.

In one embodiment, the marking device includes two or more development systems.

In one embodiment, two or more development systems incorporate developer belts of different lengths.

In one embodiment, each developer belt receives toner particles from (at least) two magnetic rollers in contact with the developer belt or sufficiently closely positioned to allow toner particles to pass therebetween.

In one embodiment, each developer belt transfers toner to a latent image formed on a surface of an image transfer member at a single transfer nip. This can provide flexibility in the positioning of the development system.

In one embodiment, the marking device includes at least two identical (universal, interchangeable) development systems.

In one embodiment, the marking device includes at least two development systems which are mirror images of each other.

In one embodiment, the marking device includes at least two vertically-stacked development systems.

In one embodiment, the marking device includes at least two horizontally-aligned development systems.

In one embodiment, the marking device includes at least eight or at least ten development systems.

In one embodiment, the marking device is used in a method of printing.

As used herein, a "printing device" or "printer" can include any device for rendering an image on print media, such as a copier, laser printer, bookmaking machine, or a multifunction device (which includes one or more additional functions such as scanning, archiving, emailing, and/or faxing).

"Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related.

A "digital image" generally may include information in electronic form which is to be rendered on the print media by the printing device and may include text, graphics, pictures, and the like. The operation of applying toner images to print media, for example, graphics, text, photographs, etc., is generally referred to herein as printing or marking.

Figure 1:
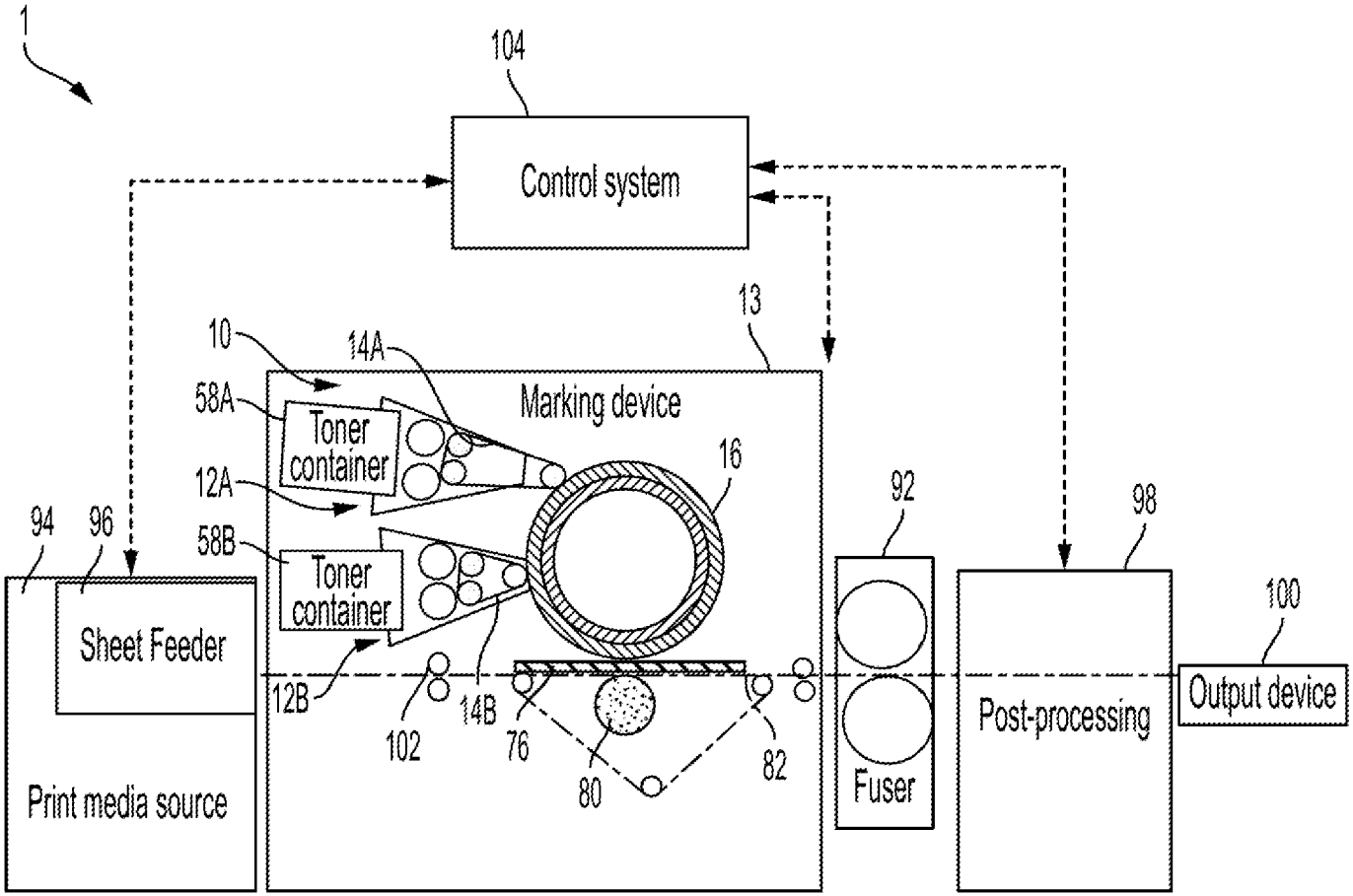
FIG. 1 is a functional block diagram of a printer including a marking device in accordance with one aspect of the exemplary embodiment.

With reference to FIG. 1, an electrophotographic printer 1 for rendering images on print media is illustrated. The printer 1 includes a marking device 10, in accordance with one exemplary embodiment. The marking device 10 incorporates one or more development systems 12A, 12B mounted in/on a common enclosure/frame 13. Each development system 12A, 12B is configured for supplying toner particles to a respective continuous developer belt 14A, 14B. The developer belt transfers the toner particles to an image transfer member 16, such as a belt or drum, which may have a photoconductive surface. While two development systems 12A, 12B are illustrated in FIG. 1, it is to be appreciated that multiple similarly-configured development systems may be arranged to supply toner particles of respective colors to the same image transfer member 16. Each development system 12A, 12B, etc. may be similarly configured, except as noted.

Figure 2:
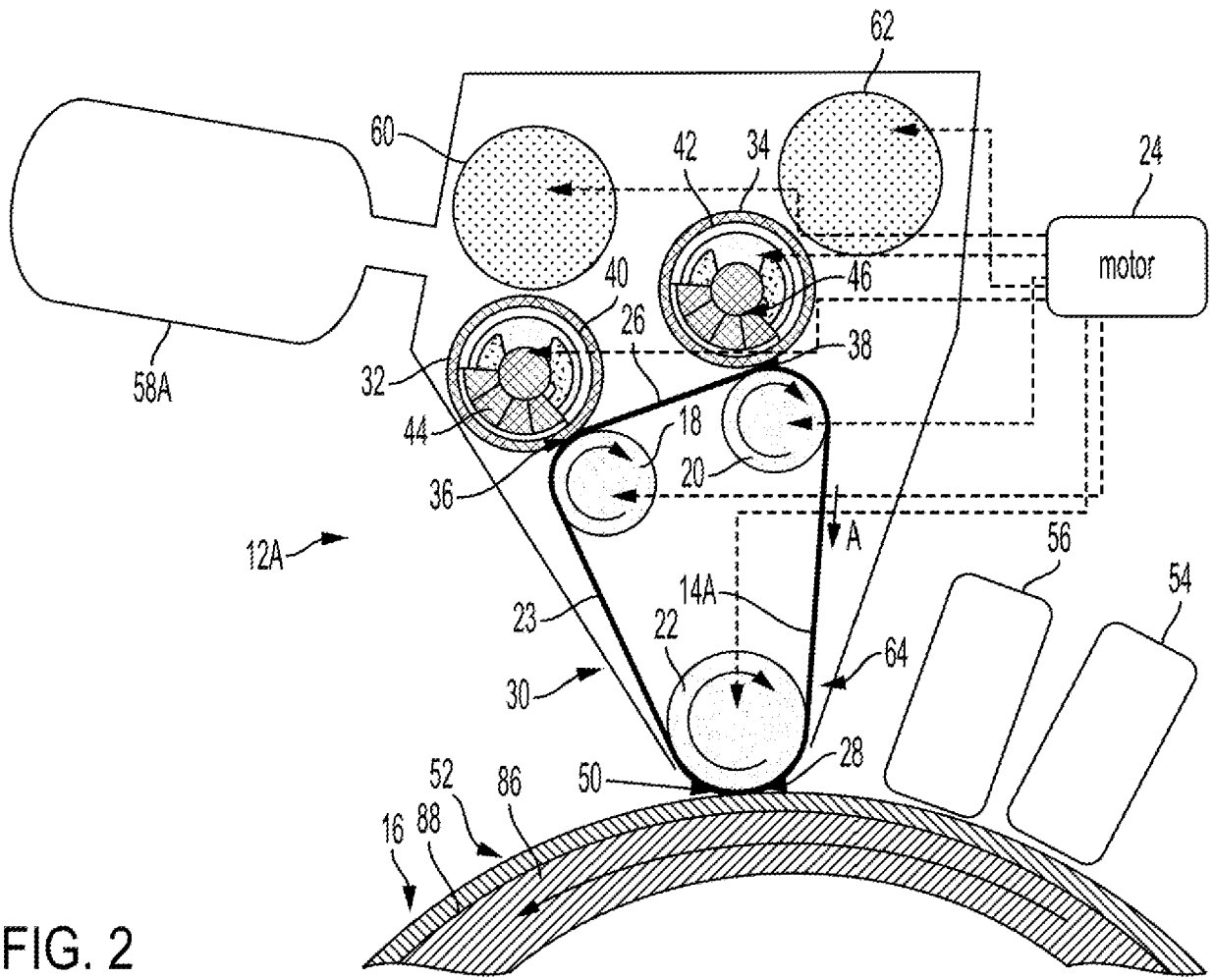
FIG. 2 is a side sectional view of a development system with a development belt suited to use in the marking device of FIG. 1.

With reference also to FIG. 2, in an exemplary development system 12A, the developer belt 14A is supported by a set of spaced developer rollers 18, 20, 22. Three developer rollers are shown in the illustrated embodiment, although in other embodiments, two developer rollers, or more than three developer rollers, or no more than four spaced developer rollers, may be employed, for each belt 14A. At least one of the rollers 18, 20, 22 is rotated to cause the developer belt 14A to move and bring different portions of an outer surface 23 of the belt 14A into contact with the image transfer member 16. The developer rollers 18, 20, 22 may be driven by a common drive system 24, which causes the belt 14A to move in the direction of arrow A. At any given time, a first portion 26 of the developer belt 14A is spaced by first and second of the developer rollers 18, 20, while a third of the developer rollers 22 maintains a second portion 28 of the belt 14A in contact with the image transfer member 16.

The developer belt 14A may have a length, in the continuous direction, of at least 4 cm, or at least 6 cm, or at least 8 cm, or up to 100 cm, or up to 50 cm. A width of the developer belt 14A, perpendicular to the length, may be a function of the width (in the cross process direction) of the image transport member 16, e.g., equal to or slightly less than the width of the image transport member 16. The thickness (smallest dimension) of the developer belt 14A may be at least 0.5 mm, or at least 1 mm, or up to 1 cm. Other developer belts 14B, etc. in the marking device 10 generally have the same thickness and width, although the length(s) may be different.

The developer rollers 18, 20, 22 may be of the same diameter or of different diameters. For example, the roller 22 which contacts the transfer member 16 may be larger in diameter than the other developer rollers 18, 20, e.g., at least 10% larger, or at least 20% larger, or at least 40% larger, or up to 100% larger. For example, developer rollers 18, 20 may each have a diameter of 4 to 12 mm, and developer roller 22 a diameter of 7 to 20 mm.

The development system 12A includes a developer housing 30, which holds a supply of a dry developer material, such as magnetic carrier granules having toner particles tribo-electrically charged and adhering thereto. The developer belt 14A is partially enclosed within the housing 30. One or more magnetic rollers ("mag rolls") 32, 34 (two mag rolls in the illustrated embodiment) is/are mounted in the housing 30. The mag rolls may be larger, in diameter, than the developer rollers 18, 20, 22. Respective development nips 36, 38 are defined between each mag roll and the developer belt 14A. In one embodiment, each mag roll 32, 34 includes a cylindrical shell or sleeve 40, 42, which is rotatable around a magnetic core 44, 46 containing a set of magnets. Alternatively, the shell 40, 42 is stationary while the core 44, 46 rotates. The shell may be formed of an electrically conductive, non-ferrous material, such as aluminum or stainless steel. In other embodiments, a magnetizable brush (not shown) takes the place of each cylindrical shell. The developer material (including the toner particles and magnetic carrier) is attracted to the mag rolls 32, 34 by magnetic forces. The toner particles are then attracted from the mag rolls to the developer belt 14A by a potential difference between the mag roll and the developer belt 14A. In particular, the toner particles are transferred from the mag roll 32, 34 to first portion 24 of the developer belt 14A at the development nip 36, 38, leaving the carrier granules behind in the developer housing 30. The developer belt 14A and the image transfer member 16 define a single transfer nip 50 between them.

The toner particles are attracted to the image transfer member 16 by a potential difference between the developer belt 14A and a surface 52 of the image transfer member 16. In the illustrated embodiment, the surface 52 is photoconductive and the toner particles are used to develop a latent image formed on the photoconductive surface 52. In particular, each development system 12 has an associated charging station 54, such as a charging corotron, which charges the photoconductive surface 52, and an exposure station 56, which forms the latent image on the photoconductive surface. The toner particles are electrostatically attracted to the latent image to form a toner image layer on the surface 52. Residual toner particles, which are not needed to form the toner image layer, may return on the developer belt 14A to the developer housing 30 to be reused.

In contrast to the image transfer member 16, the developer belt 14A carries toner particles (a relatively continuous layer of toner particles) but does not carry toner image layers (areas of toner particles spaced by areas of no toner particles where the image transfer member has been exposed/not exposed, respectively), since there is no associated charging station or exposure station 56 for the developer belt 14A.

The toner particles may be supplied to the housing 30 from a replaceable toner container 58A. Augers 60, 62, within the housing 30, mix the toner particles with the magnetic carrier granules. While two augurs are shown, separate augurs may be provided for mixing and for aiding pickup of developer on to the mag rolls. In some embodiments, intermediate mag rolls (not shown) may be positioned between the augers 60, 62 and mag rolls 32, 34 such that the toner concentration is higher on the mag rolls 32, 34.

The developer belt 14A exits the housing 30 through a narrow slot 64. Suction may be applied in the area of the slot to minimize the escape of developer particles. Seals may also be used to limit the escape of developer particles.

The augers 60, 62, mag rolls 32, 34, and developer rollers 18, 20, 22 may all be driven by a common drive system 24, such as a motor with suitable gears and/or belts. Alternatively, separate drive systems may be employed. The drive system 24 controls the speed of the developer rollers 18, 20, 22, such that the developer belt 14A matches or approximates the speed of the surface of the driven image transfer member 16. In other embodiments, the speeds of the developer belt and of the surface of the driven image transfer member need not closely match and, for example, may have a speed ratio of up to 1.2:1.

One advantage of the development system of FIG. 2 is that it allows the dual mag rolls 32, 34 to be smaller in diameter than in conventional systems where a single, large diameter mag roll is used to transfer toner to a photoconductive surface. For example, two mag rolls 32, 34 of 22 mm in diameter can be fitted into a smaller developer housing 30 than a conventional 30 mm mag roll.

Another advantage is that the two small mag rolls 32, 34 provide two development nips 36, 38, which can provide a greater development latitude in a limited design space.

Another advantage is that the single nip 50 between the developer belt 14A and the image transfer member 16 provides flexibility in the final positioning of the developer housing 30, which allows for a universal or semi-universal (interchangeable) development system 12A. The single nip 50 also reduces or eliminates the need to align a mag roll development nip frequently. This allows various interfaces in the developer housing to be maintained in a constant relationship when moving the development housing 30 to new positions in the marking device. These interfaces may include the mag roll to auger relationships, the mix auger to pickup auger relationship (where present), and dispenser to mix auger relationship.

Figure 3:
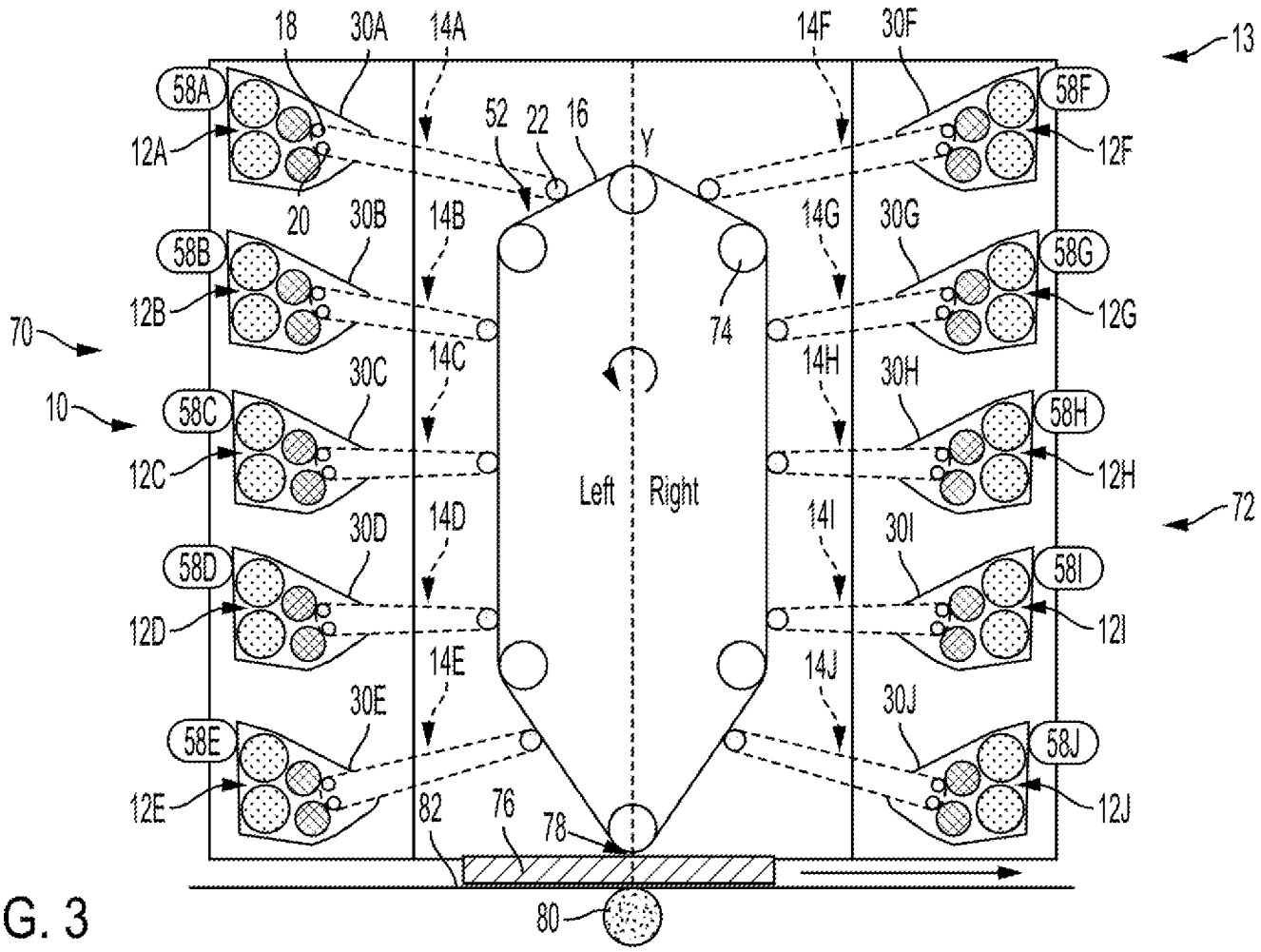
FIG. 3 is a side sectional view of a marking device incorporating a set of development systems and a belt-type image transfer member in accordance with another aspect of the exemplary embodiment.
Figure 4:
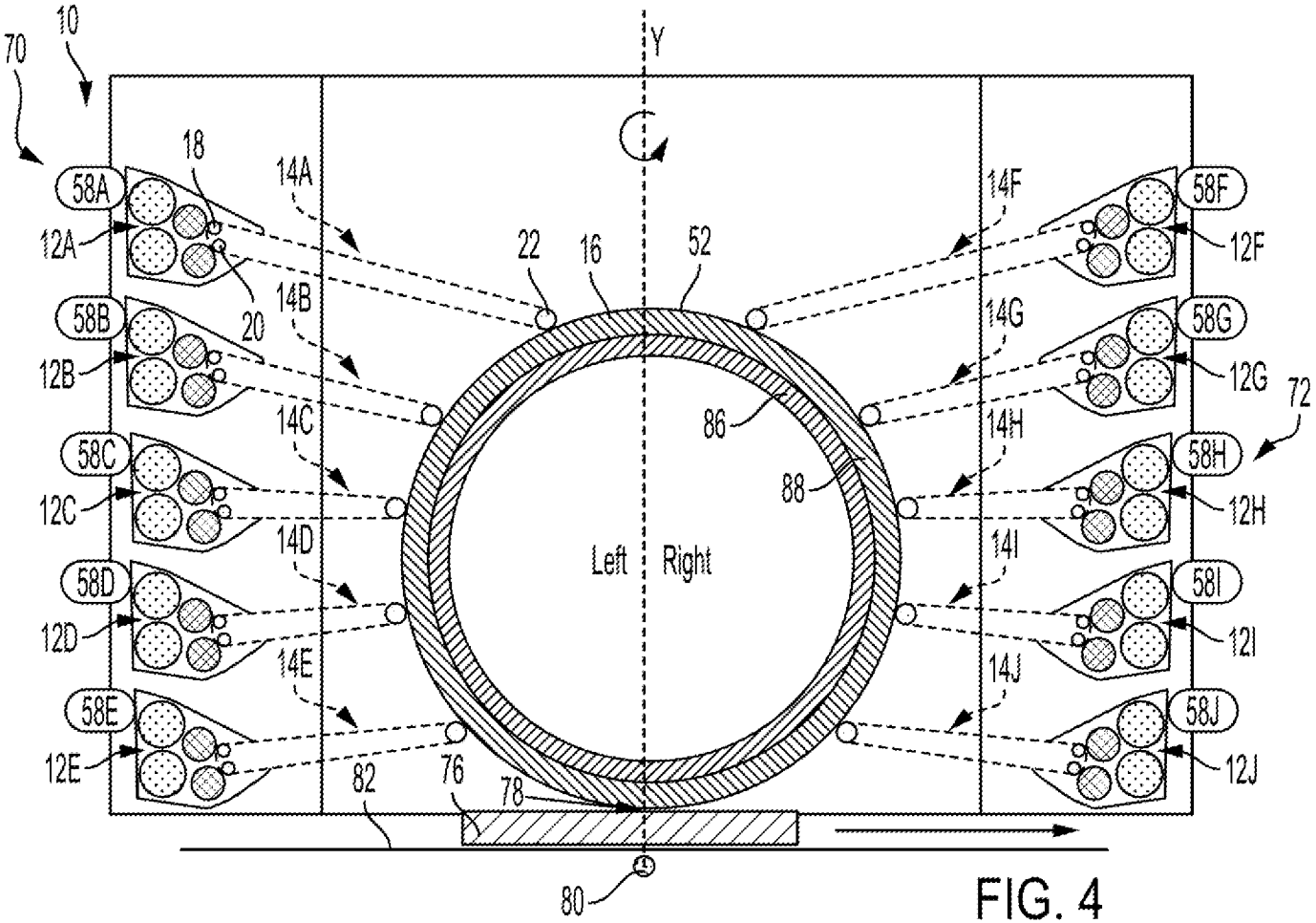
FIG. 4 is a side sectional view of a marking device incorporating a set of development systems and a drum-type image transfer member in accordance with another aspect of the exemplary embodiment.
Figure 5:
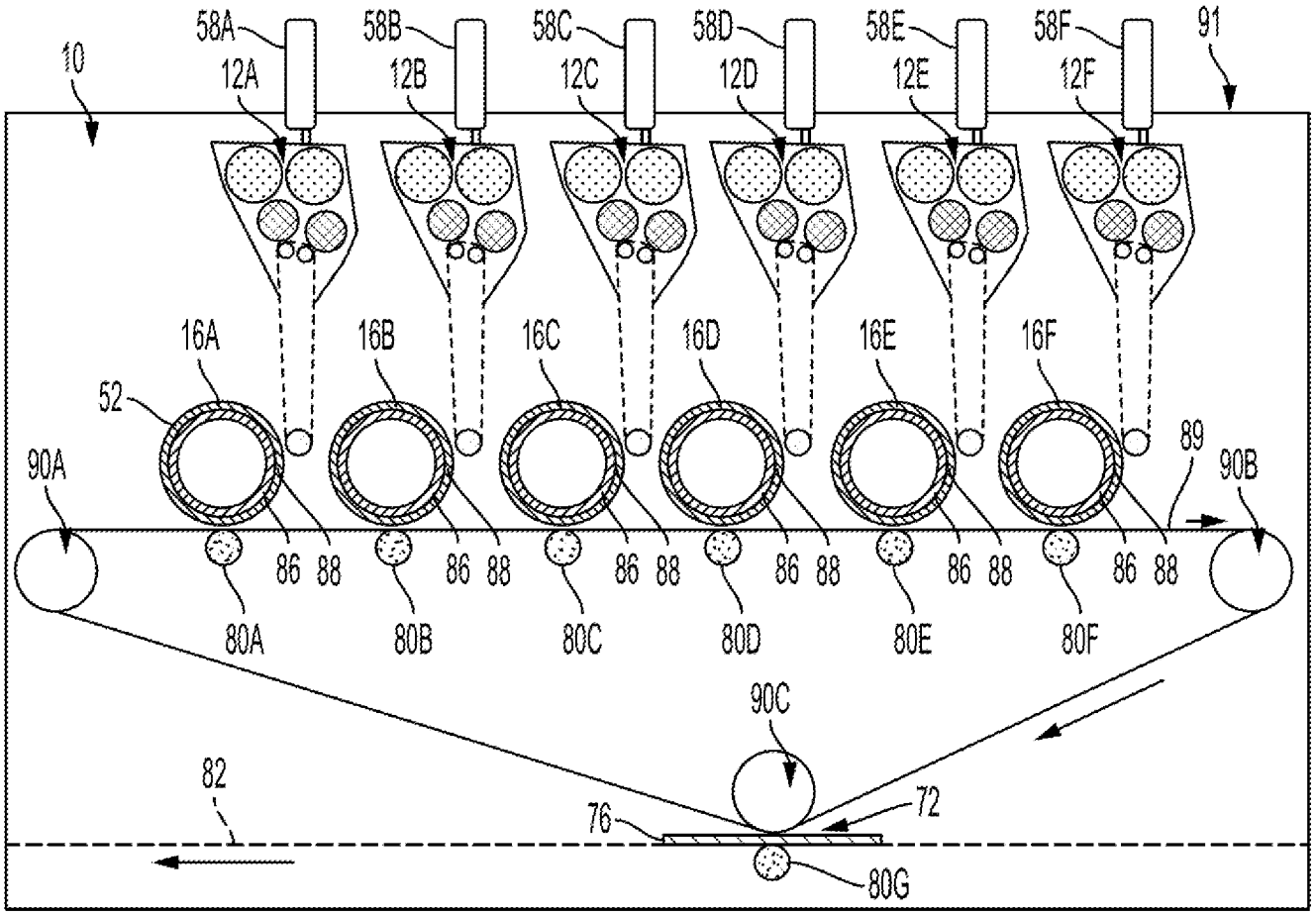
FIG. 5 is a side sectional view of a marking device incorporating a set of development systems and a set of drum-type image transfer members in accordance with another aspect of the exemplary embodiment.

Another advantage is that a greater number of development systems 12A, 12B, etc., can be accommodated around a single image transfer member 16 than in a conventional marking device. For example, eight or ten development systems 12A, 12B, etc., can be installed around a drum transfer member 16 of about 84 mm in size. While in FIG. 2, the developer roller 22 is partially enclosed within the housing 30, in other embodiments, the developer roller 22 may be outward of the housing 30, as illustrated in the embodiments of FIGS. 3-5. This assists in enabling a larger number of development systems 12A, 12B, etc., to be accommodated around a conventionally-sized transfer member 16.

With reference now to FIG. 3, in one embodiment, the marking device 10 includes a first set of interchangeable development systems 12A, 12B, 12C, 12D, and 12E, vertically arranged on a left side of the marking device, and a second set of interchangeable development systems 12F, 12G, 12H, 121, and 12H, vertically arranged on a right side of the marking device. The first set of interchangeable development systems may each be configured as shown in FIG. 2, with the only difference between the five left-side development systems 12A-E being the length of the developer belt 14A, 14B, etc., position of the roller 22 relative to rollers 18, 20, and possibly an adjustment to a position of the slot 64 (FIG. 2), through which the belt enters and exits the housing. For example, developer belts 14A and 14E are longer than developer belts 14B and 14D, e.g., at least 5%, or at least 10% longer, or have a difference in length of at least 0.3 cm, or at least 0.5 cm, or at least 1 cm, or at least 2 cm. Developer belts 14B and 14D are longer than developer belt 14C, e.g., at least 2%, or at least 5% longer.

The second set of interchangeable development systems 12F, 12G, 12H, 121, and 12H may each be configured as mirror images to the development systems on the first side (with Y defining the axis of symmetry of the marking device). The only difference between the five right-side development systems being the length of the developer belt 14F, 14G, etc., position of the roller 22 relative to rollers 18, 20, and possibly an adjustment to a position of the slot 64, through which the belt enters and exits the housing The belt length is selected based on the distance to the image transfer member 16.

Using different lengths of the developer belt 14A, 14B, etc. allows the development systems on each side to be stacked vertically, which can make them more accessible from adjacent sides 70, 72 of the marking device, e.g., for replacement of the toner containers 58A-J, which can also be vertically stacked.

The marking device 10 of embodiment of FIG. 3 can thus be constructed from only two interchangeable development system types, a left-side type, configured as for system 12A, and a right-side type, configured as for system 12F. This reduces the unit manufacturing cost for the marking device 10 and also reduces the number of replacement development systems 12A, 12F (or components thereof) that the manufacturer or customer needs to have on hand for repairing the marking device.

While eight development systems 12A, 12B, etc., are illustrated in FIG. 3, it is to be appreciated that fewer or more development systems may be employed, such as three, four, five, or six development systems. Each development system develops latent images with a respective toner color, such as cyan, magenta, yellow, or black, or one of a set of custom toners, such as white, metallic, clear, magnetic, and the like.

While not shown, the developer housing 30 may include suitable manifolds, endcaps, electrical connections, and the like, which may be adapted to have the ability to be used in right and left side housings to provide a universal housing or substantially universal housing.

In the embodiment of FIG. 3, the image transfer member 16 is in the form of a continuous belt with a photoconductive surface 52. The belt is carried by a set of transfer rollers 74 (six transfer rollers in the illustrated embodiment), one or more of which is/are driven by an associated drive system (not illustrated). The latent images are formed on the belt 16 by associated charging and exposure stations (not shown, for ease of illustration), as described for FIG. 2. The toner image layers formed by the development systems on the image transfer belt 16 are transferred to a sheet of print media 76 as it passes through a nip 78 to form a multi-layer toner image. A transfer corotron 80 assists in attracting the toner images to the sheet 76. A transport member 82, such as a conveyor belt, plate with sheet-moving rollers, or the like, transports the sheet of print media 76 through the nip.

In addition to the advantages previously noted, the embodiment of FIG. 3 allows the development systems 12A-F to be positioned at different distances from the image transfer belt 16, by providing different length developer belts 14A-J. This enables a centralized location for the developer housings and opens up additional room around the image transfer belt 16, for modules for cleaning, charging, and discharging the belt 16.

Another advantage is that the developer housings 30A-30J can be closer to the respective toner bottles 58A-58J, avoiding complex dispensing lines. This facilitates making the development system and toner container an integrated interchangeable unit.

Another advantage is that the size of the marking device enclosure 13 can be significantly reduced, as compared to existing marking devices. A 30-50% reduction in the footprint of the marking device is to be expected.

FIG. 4 illustrates another embodiment of a marking device 10, which is suited to use in the system of FIG. 1. The marking device 10 may be configured similarly to the marking device of FIG. 3, except as noted. Similar elements are accorded the same numerals. The image transfer member 16 of this embodiment includes a hollow cylindrical drum 86, which is formed, for example, of an electrically-conductive metal, and covered by a layer 88 of polymeric, photoconductive material, which defines the photoconductive surface 52. The drum transfer member 16 is driven by an associated drive system (not illustrated). The latent images are formed on the surface 52 of the drum transfer member 16 by associated charging and exposure stations (not shown, for ease of illustration), as described for FIG. 2. The toner image layers formed by the development systems 12A-J on the drum transfer member 16 are transferred to a sheet of print media 76 as it passes through the nip 78 between the drum transfer member 16 and the transport member 82. The transfer corotron 80 assists in attracting the toner image layers to the sheet 76.

FIG. 5 illustrates another embodiment of a marking device 10, which is suited to use in the system of FIG. 1. The marking device 10 may be configured similarly to the marking device of FIG. 4, except as noted. Similar elements are accorded the same numerals. In this embodiment, the marking device includes a set of image transfer members 16A-F, one for each of a set of development systems 12A-F. Each of the image transfer members 16A-F is in the form of a hollow cylindrical drum, as described for FIG. 4, with a photoconductive surface 52. Each of the drum transfer members 16A-F is driven by an associated drive system (not illustrated). Alternatively, a common drive system may drive all of the drum transfer members 16A-F. The latent images are formed on the respective surface 52 of the transfer members 16A-F by associated charging and exposure stations (not shown, for ease of illustration), as described for FIG. 2. The toner image layers formed by the development systems 12A-F on the transfer members 16A-F are transferred to an intermediate transfer member in the form of a belt 89, carried by a set of driven rollers 90A, 90B, 90C. Transfer corotrons 80A-F, associated with the drum transfer members 16A-F, respectively, assist in transferring the toner image layers to the belt 89. The transferred images are transferred from the belt 89 to a sheet of print media 76 as it passes through a nip 78 between the belt and the transport member 82, adjacent roller 90. A transfer corotron 80G, beneath the transport member 82 transport member 82, assist in attracting the toner image layers to the sheet 76.

In this embodiment, each of the development systems 12A-F may be configured identically, and be horizontally aligned, allowing respective toner containers 58A-F to be accessible from an upper end 91 of the marking device enclosure.

In another embodiment, the upper, horizontal portion, of the belt 89 serves as the transport member 82 (not illustrated) 76 and corotron 80G is omitted.

While FIGS. 3-4 illustrate transfer of toner image layers directly from the image transfer member 16, 16A, etc. to a sheet, in the embodiment of FIG. 5, images are transferred from the image transfer member 16, 16A, etc., to an intermediate transfer member 89, such as a belt, from which the toner image layer is transferred to the sheet of print media. This arrangement may also be advantageous when a larger number of development systems are to be accommodated, allowing a first set of the development systems to be arranged around a first image transfer member and a second set of the development systems to be arranged around a second image transfer member, the first and second image transfer members transferring the respective toner image layers to the intermediate transfer member.

Figure 6:
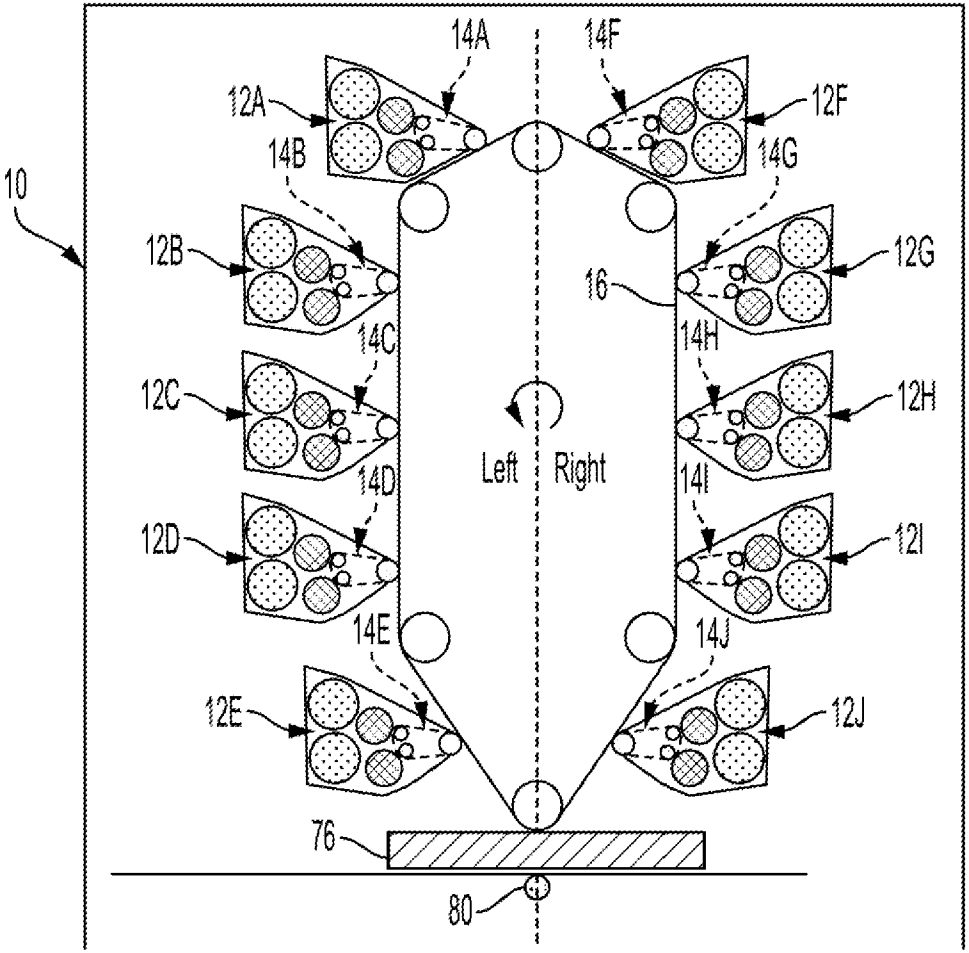
FIG. 6 is a side sectional view of a marking device incorporating a set of development systems with developer belts of equal length and a belt-type image transfer member in accordance with another aspect of the exemplary embodiment.

FIG. 6 illustrates an embodiment of a marking device 10 similar to that of FIG. 3, except in that the developer belts 14A-J are all the same length. This allows the left side development systems 12A-E to be identical to each other and the right side development systems 12A-F to be identical to each other and mirror images of the left side development systems. Commonality between developer housings 30A-J reduces cost of manufacture and replacement parts.

Another advantage of various embodiments described herein is that versatility of the placement of developer housings around a drum or belt image transfer member can provide an increased color gamut and/or additional colors/coatings etc.

Returning to FIG. 1, the multi-layer toner image may be more permanently attached to the sheet 76 by means of heat and/or pressure, e.g., by a fuser 92. The fuser may be downstream of the marking device 10, within the marking device enclosure. In the embodiment of FIG. 5, there may be a single fuser positioned downstream of the last drum transfer member 16F. Alternatively, a respective fuser may be positioned downstream of each of the transfer members 16A-F, to fuse each toner image layer before the next one is laid down on the sheet.

Also shown in FIG. 1 are a print media source 94, a sheet feeder 96, an optional post-processing device 98, and an output device 100, which are connected by a sheet transport system 102. Each of the components 10, 92, 94, 96, 98, 100, and 102 may be under the control of a common control system 104. The print media source 94 contains a supply of print media sheets 76, e.g., in one or more supply trays. The sheet feeder 96 feeds the sheets in single file to the sheet conveyor system 102. The sheet transport system 102, which includes the transport member 82, conveys the sheets downstream to the marking device 10, fuser 92, optional post processing device 98 and finally to the output device 100. The sheet transport system 102 may include rollers, airjets, conveyor belts, or a combination thereof. In some embodiments, the sheet transport system 102 may provide a return path for inverting and returning printed sheets to the marking device 10 and fuser 92 for printing a toner image on the second side of the printed sheet 76 (duplex printing). The optional post processing device 98 may include one or more of a stacker, binder, stapler, hole puncher, sheet folder, or the like. The output device 100 may include one or more output trays, from which the printed, and optionally post-processed, sheets 76 can be collected by a user. The control system 104 may include memory storing software which is executed by an associated hardware processor to operate the other components 10, 92 94, 96, 98, 100, and 102 of the printer 1 during printing.

Figure 7:
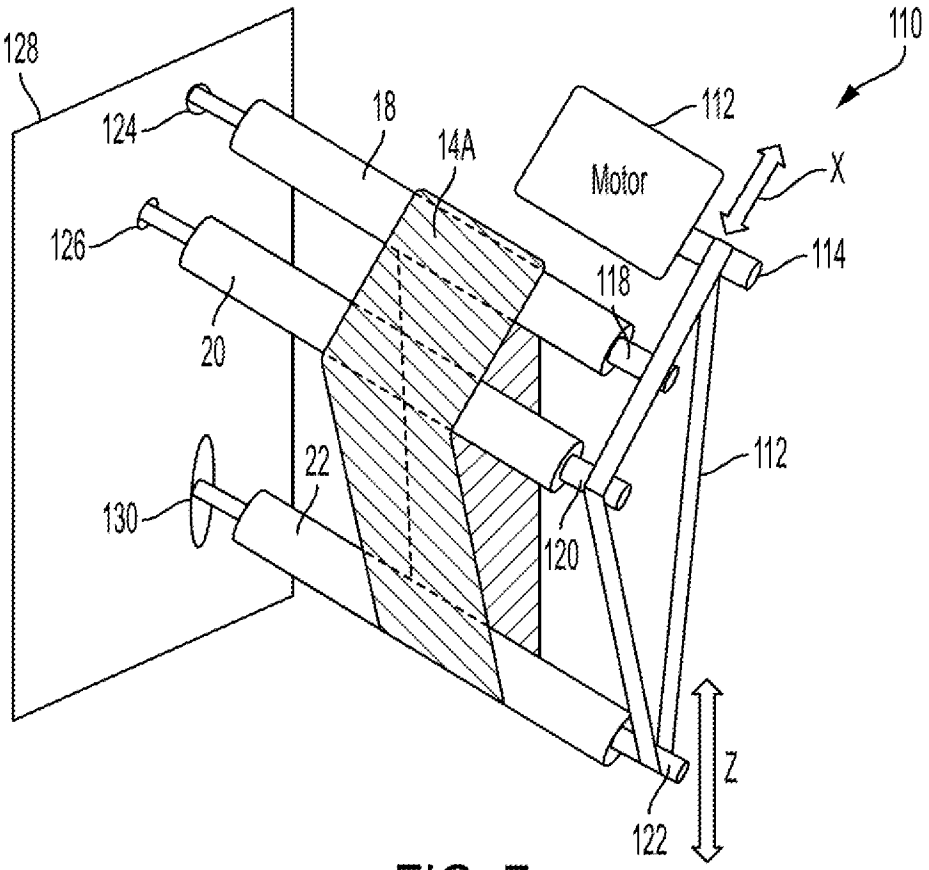
FIG. 7 is a perspective view of a drive mechanism which accommodates different lengths of developer belts in accordance with another aspect of the exemplary embodiment.

With reference now to FIG. 7, a drive mechanism 110 suited to accommodating different lengths of developer belt 14A, 14B, etc., is illustrated. The drive mechanism includes a motor 112 which drives a drive shaft 114. The drive shaft carries a drive belt 116, which rotates shafts 118, 120, 122 of the three rollers 18, 20, 22 The drive shaft 114, and/or the motor 114, is repositionable, as illustrated by arrow X. This allows the drive belt 112 to remain taut when the roller 22 is repositioned, as illustrated by arrow Z. For example, when a longer developer belt 14A is used, the roller 22 is displaced further from rollers 18, 20 and the drive shaft 114/motor 112 is moved nearer to the closest of rollers 18 and 20. The ends of shafts 118, 120 are positioned in slots 124, 126 in a support member 128, which constrain the rollers to rotational movement, while the end of shaft 122 is repositionable vertically in a slot 130. As will be appreciated, other mechanisms for accommodate different lengths of developer belt 14A, 14B, etc., are also contemplated. For example, drive belts 112 of different lengths may be provided.

Figure 8:
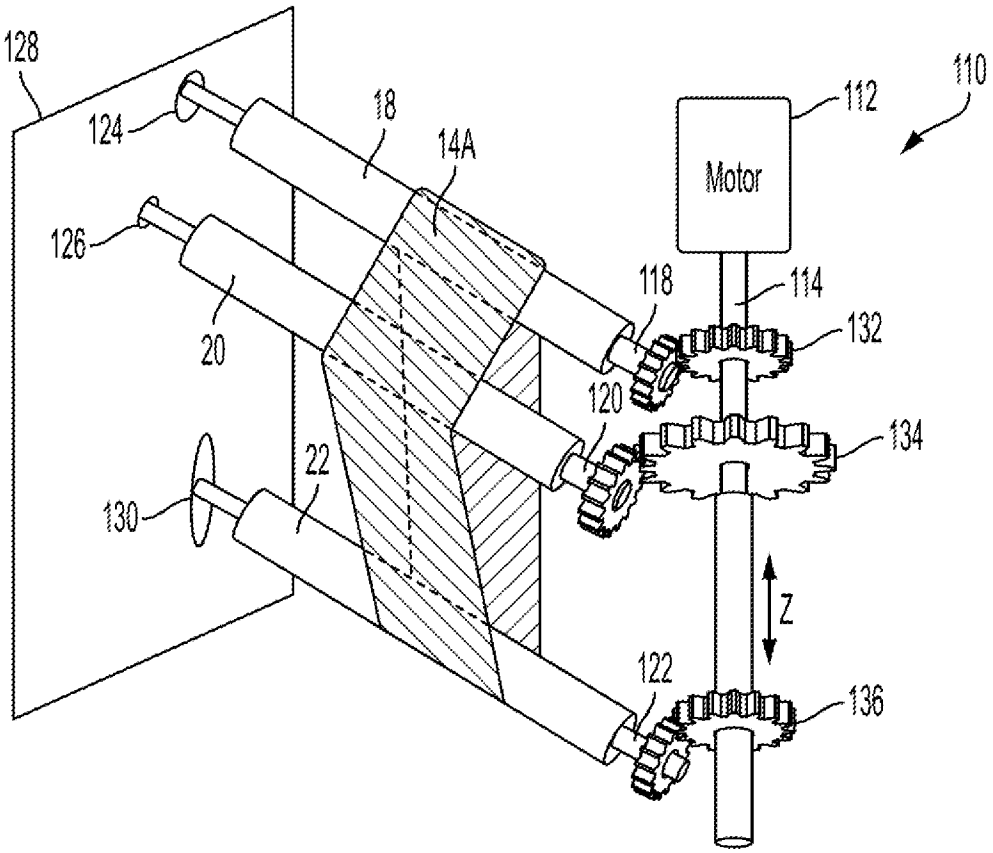
FIG. 8 is a perspective view of a drive mechanism which accommodates different lengths of developer belts in accordance with another aspect of the exemplary embodiment.

In another embodiment, gear mechanisms 132, 134, 136 carried by a telescoping drive shaft may be employed, as illustrated in FIG. 8. This allows the gear mechanism 136 to be moved further from the motor 112, in the direction of arrow Z, when a longer developer belt 14B is used.

The image transfer belt 16 illustrated in FIGS. 3 and 6, for example, may be formed of an electrically-conductive material. Suitable materials include polymers in which electrically conductive particles are dispersed in at least a portion thereof. For example, an outer layer of the image transfer belt 16, 16A, 16B, etc., may include a first layer which includes carbon black particles. Carbon black particles have a high electrical conductivity and are capable of increasing electrical conductivity to a high degree even when the amount of carbon black particles used is small. Examples of the carbon black particles included in the first layer include Ketjenblack, oil-furnace black, channel black, acetylene black, and surface-oxidized carbon black. Among these, surface-treated carbon black is advantageous in terms of consistency of electric resistance over time. As the polymer, a polyimide-based resin may be employed, such as a polyimide resin, a polyamideimide resin, a polyetherimide resin, a siloxane-modified polyimide resin, a siloxane-modified polyamide-imide resin, a mixture of a polyamide-imide and a polybenzimidazole, a fluoropolyimide, or combination thereof. See, for example, US Pub. Nos. 20110244247A1, 20120183783A1, 20130273373A1, 20150227065A1, 20200325333A1, 20200326645A1, and 20200356029A1, incorporated herein by reference in their entireties, for examples of such polymeric materials.

In the case of a drum-shaped image transfer member 16, 16A, 16B, etc., as illustrated in FIGS. 2, 4, and 5, the outer layer 88 may be similarly constructed to the image transfer belt 16, 16A, 16B described above. However, the layer 88 can be thinner than a belt since it is not self-supporting.

The developer belt 14A, B, C, etc. of FIGS. 2-8 can be formed of any suitable material which can be charged, relative to the mag rolls, to attract toner particles to the developer belt. Suitable materials include those described for the image transfer member 16, 16A, etc. (or polymeric layer thereof, in the case of a drum). The developer belt 14A, B, C, etc. can be an endless belt which is seamed or seamless.

The image transfer member (belt or drum) may be coated with a ceramic or ceramer type coating. Ceramers are sinterable high performance polymers based on polyphenylene sulfone ($PPSO_2$). The coating may be 0.01-5 mm thick, such as at least 0.05 mm or up to 0.3 mm in thickness. Ceramic coatings, for example, can provide 10 Megaohms/$cm^3$ for a 0.13 mm thick ceramic coating, measured at 200 V, and a volume resistivity of $6\times10^7$ at a field of 1.5 V/micron.

Figure 9:
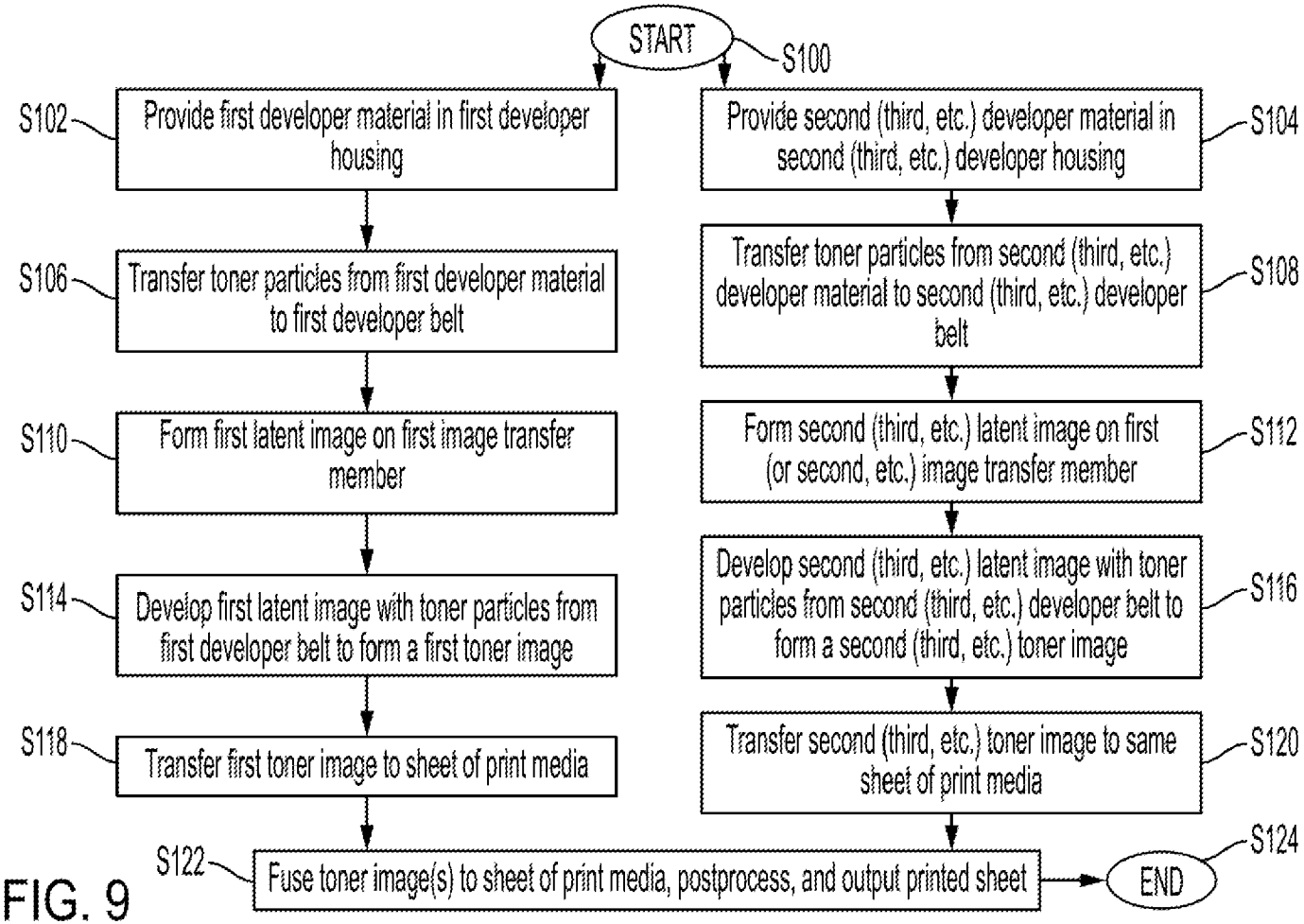
FIG. 9 illustrates a method of printing in accordance with another aspect of the exemplary embodiment.

With reference now to FIG. 9, a method of printing is illustrated which can be performed with one or more of the exemplary developer system(s) described herein. The method begins at S100.

At S102, a first developer material is provided in a first developer housing 30A of a first development system 12A, the first developer material including first toner particles.

At S104, S102 may be repeated for one or more additional development system 12B, 12C, etc.

At S106, some of the first toner particles are transferred to a first continuous developer belt 14A of the first development system 12A, e.g., by at least one magnetic roller 32, 34.

At S108, S106 may be repeated for each additional developer system.

At S110, a first latent image is formed on a first image transfer member 16, 16A.

At S112, S110 may be repeated for each additional developer system, wherein the latent image is formed on the first image transfer member 16, 16A or on an additional image transfer member 16B, 16C, etc.

At S114, the first latent image is developed on the first image transfer member with some of the toner particles transferred from the first developer belt 14A to form a first toner image layer.

At S116, S114 may be repeated for each additional developer system wherein the latent image is developed on the first image transfer member 16 or on the additional image transfer member 16B, 16C, etc., to form an additional toner image layer, on top of or spaced from the first toner image layer.

At S118, the first toner image layer is transferred from the first image transfer member to a sheet 76 of print media.

At S120, additional toner image layer(s) may be transferred from the first image transfer member 16 (or from the additional image transfer member 16B, 16C, etc., where present) to the sheet 76 of print media.

At S122, the sheet, with the toner image(s) thereon may be fused, optionally post-processed, and output.

In some embodiments, the printed sheet may be inverted and returned to the marking device for printing on a second side of the sheet, as described for S106-S122, prior to optionally being post-processed and output.

The method ends at S124.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A marking device comprising:

an image transfer member; and a plurality of development systems, each of the development systems comprising:

a housing configured for accommodating a developer material which includes toner particles;

at least one magnetic roller within the housing which attracts the developer material to a surface thereof;

a continuous developer belt which attracts the toner particles from the at least one magnetic roller to a surface of the developer belt; and a plurality of developer rollers which carry the developer belt around them, one of the developer rollers being positioned adjacent to the image transfer member whereby some of the toner particles are transferred to a latent image formed on the image transfer member;

wherein at least two of the plurality of development systems are vertically-stacked, one directly on top of the other, the developer belt of a first of the at least two development systems having a first length and the developer belt of a second of the at least two development systems having a second length, which is longer than the first length, based on a distance of the respective development systems to the image transfer member.

2. The marking device of claim 1, wherein in each of the plurality of development systems, the at least one magnetic roller comprises two magnetic rollers.

3. The marking device of claim 1, wherein in each of the plurality of development systems, the plurality of developer rollers includes three developer rollers.

4. The marking device of claim 1, wherein in each of the plurality of development systems, the set of developer rollers is driven by a common drive mechanism.

5. The marking device of claim 1, wherein at least two of the plurality of development systems are interchangeable.

6. The marking device of claim 1, wherein at least two of the plurality of development systems are mirror images of each other.

7. The marking device of claim 1, wherein at least two of the plurality of development systems are horizontally-aligned.

8. The marking device of claim 1, wherein the marking device includes at least eight of the development systems.

9. The marking device of claim 1, wherein the image transfer member comprises one of a belt and a drum with a photoconductive layer.

10. A printer comprising the marking device of claim 1 and a sheet transport system which conveys associated sheets of print media through the marking device to receive toner image layers from the image transfer member.

11. A method of printing comprising:

providing a first developer material in a first housing, the first developer material including first toner particles;

transferring some of the first toner particles to a first continuous developer belt;

developing a first latent image on a first image transfer member with some of the transferred toner particles to form a first toner image layer; and transferring the first toner image layer to a sheet of print media;

providing a second developer material in a second housing, the second developer material including second toner particles;

transferring some of the second toner particles to a second continuous developer belt;

developing a second latent image on the first image transfer member or on a second image transfer member with some of the transferred second toner particles to form a second toner image layer, the second continuous developer belt having a different length to the first continuous developer belt, based on a distance to the image transfer member on which the second latent image is developed; and transferring the second toner image layer to the sheet of print media.

12. The method of claim 11, wherein the second latent image is developed on the first image transfer member.

13. A printer comprising:

a print media source;

a marking device which receives print media from the print media source and applies toner images to the print media, the marking device comprising:

an image transfer member;

at least one charging station, which charges a photoconductive surface of the image transfer member;

an exposure station, which forms a latent image on the charged photoconductive surface;

a plurality of development systems, at least two of the plurality of development systems each comprising:

a housing configured for accommodating a developer material which includes toner particles;

a continuous developer belt which carries the toner particles from the housing to the surface of the image transfer member to develop the latent image on the image transfer member to form a toner image layer, the first development system having a longer developer belt than the second development system; and a sheet transport system which conveys a sheet of the print media from the print media source to the marking device to receive the toner image layer from the image transfer member.

* * * * *